United States Patent [19]

Grahm

[11] Patent Number: 4,981,242

[45] Date of Patent: Jan. 1, 1991

[54] ADJUSTABLE GARMENT HANGER STRUCTURE

[76] Inventor: Robert D. Grahm, 10115 Bridlevale Dr., Los Angeles, Calif. 90064

[21] Appl. No.: 478,160

[22] Filed: Feb. 9, 1990

[51] Int. Cl.[5] ..... A47G 25/40; A47G 25/28; A47G 25/20; A47G 25/14

[52] U.S. Cl. ..... 223/94; 223/85; 223/89; 223/88; 223/92

[58] Field of Search ..... 223/85, 89, 92, 94, 223/88, 95, 98; 211/113; D6/315, 318

[56] References Cited

U.S. PATENT DOCUMENTS

| | | | |
|---|---|---|---|
| 1,073,599 | 9/1913 | Gilsdorf | 223/92 |
| 1,352,382 | 9/1920 | Riddick | 223/88 |
| 2,099,308 | 11/1937 | McAllister | 223/98 |
| 2,622,774 | 12/1952 | Freeman | 233/67 |
| 2,652,957 | 9/1953 | Wolf | 223/92 |
| 2,707,070 | 4/1955 | Tanzer | 223/94 |
| 2,947,454 | 8/1960 | Brewer | 223/95 |
| 3,537,625 | 11/1970 | Nuttall | 223/85 |
| 4,593,839 | 6/1986 | Vanduros | 223/95 |

*Primary Examiner*—Werner H. Schroeder
*Assistant Examiner*—Bibhu Mohanty
*Attorney, Agent, or Firm*—I. Michael Bak-Boychuk

[57] ABSTRACT

A clothes hanger assembly includes a tubular center segment through which a deformable wire extends. The exposed ends of the wire are inserted into tubular foam rubber sleeves which are then compressed by end pieces threaded onto the wire ends. The center piece is dished at its ends to form recesses into which the foam sleeves are compressed fixing the wire to the piece by compression of the foam. Each sleeve is skinned on the outside for hoop retention.

3 Claims, 1 Drawing Sheet

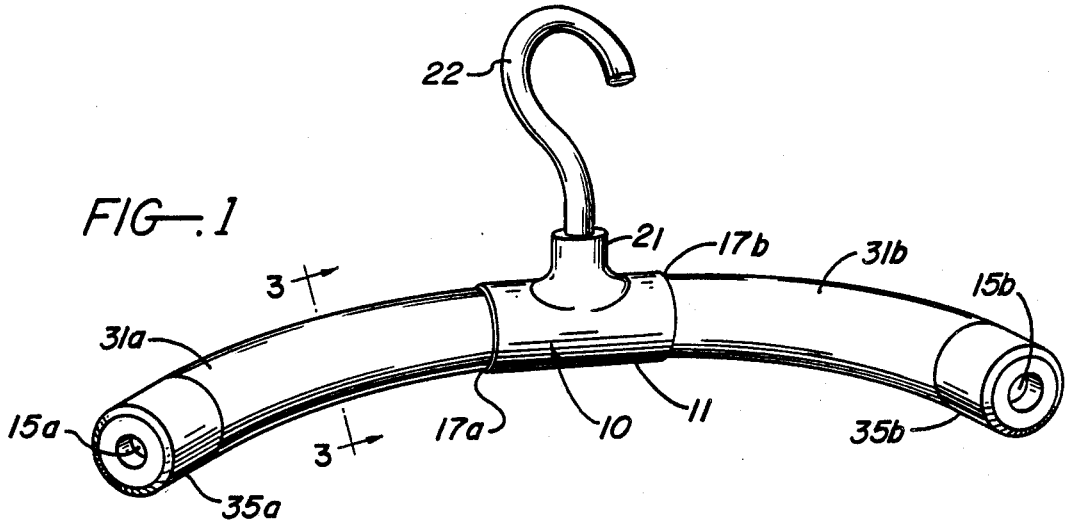
FIG—.1
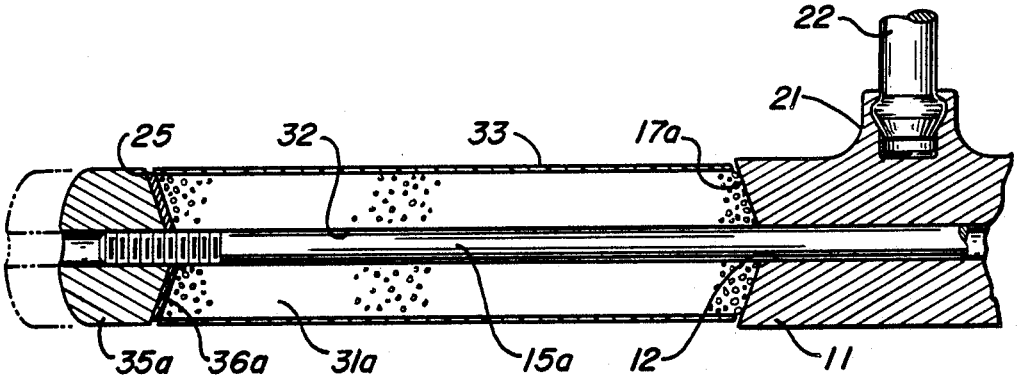
FIG—.2
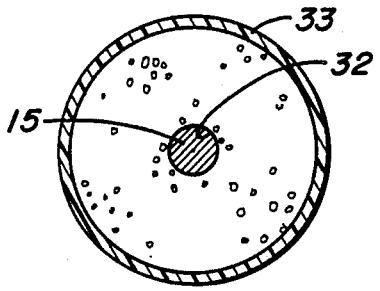
FIG—.3

ADJUSTABLE GARMENT HANGER STRUCTURE

BACKGROUND OF THE INVENTION

1. Field of the Invention

The present invention relates to clothes hangers, and more particularly to deformable clothes hangers which conform to various garments.

2. Description of the Prior Art

Garment hangers of various forms have been devised in the past. In most instances the hanger is conformed to the shape of a particular garment and, as result, a variety of hanger forms are required for a full complement of garment shapes. These distinct hanger variants become more refined as a better fit to each garment shape is demanded. The size of this complement of hanger shapes then quickly reaches the limits of practicality.

In consequence, various hangers have been devised in the past which, in one manner or another, are re-formable by the user to his particular garment shape. Examples of such garment hangers are described in U.S. Pat. No. 2,652,957 to Wolf; U.S. Pat. No. 2,707,070 to Tanzer; U.S. Pat. No. 2,622,774 to Freeman; and U.S. Pat. No. 2,668,426 to Schuster. Each one of these, while suitable for the purposes intended, entails aspects of fabrication or use which limit general acceptance,. For example, the '426 patent to Schuster provides for a segmented array on a tensioned member; Freeman '774 speaks of an inflatable structure; Wolf '957 deploys foam padding on a rigid skeleton; and Tanzer '070 shows an articulated structure to form a display stand.

A device which is somewhat more expedient in fabrication and somewhat more conveniently deformed is extensively sought and it is one such device that is disclosed herein.

SUMMARY OF THE INVENTION

Accordingly, it is the general purpose and object of the present invention to provide a deformable hanger structure which is dimensionally compressed to maintain the deformed shape.

Other objects of the invention are to provide a deformable hanger which is stable in a variety of formed shapes.

Yet further objects of the invention are to provide a deformable hanger which is convenient in fabrication and use.

Briefly, these and other objects are accomplished within the present invention by providing a soft, metal spine, generally of an elongate cylindrical section and threaded over the exterior surface proximate each end thereof. Two foam rubber tubular sleeves are then mounted on the spine adjacent each end of a central, tubular fitting. Preferably, each of the sleeves is characterized by a central, axial opening conformed to the exterior dimensions of the spine and a skinned polymeric exterior surface which is dimensionally less compliant than the foam sleeve material itself. This differential in elastic compliance is useful to effect hoop retention upon the longitudinal compression of each sleeve. To effect such longitudinal compression the distal end of each sleeve is fitted with a dished annular insert conformed to mate with a projecting annular surface formed on the opposed side of a corresponding threaded plug. These threaded plugs are threadably advanced onto the ends of the spine, compressing the sleeves against the tubular fitting.

The exposed ends of the central fitting are chamfered towards the interior, thus accumulating the compressed foam material in the course of compression of the sleeves. In this manner foam material is compressed against the surface of the spine and the fitting ends to secure the fitting to the spine both axially and in rotation.

BRIEF DESCRIPTION OF THE DRAWINGS

FIG. 1 is a perspective illustration of the inventive clothes hanger;

FIG. 2 is a sectional front view of the inventive clothes hanger shown in FIG. 1; and FIG. 3 is a sectional view taken along line 3—3 of FIG. 1.

DESCRIPTION OF THE PREFERRED EMBODIMENT

As shown in FIGS. 1–3 the inventive garment hanger, generally designated by the numeral 10, includes a central cylindrical fitting 11 provided with a longitudinal bore 12 conformed to receive a length of soft, manually bendable wire or rod 15. Preferably, wire 15 is positioned generally centrally in bore 12 to expose substantially equal segments on either side thereof.

Thus, a generally symmetrical configuration is formed on either side of an orthogonal mounting boss 21 from which a hanger hook 22 is deployed. This symmetrical structure allows for a convenient presentation by reference to one side only and a description of the other side is not required.

Specifically, wire 15 extends equal wire segments **15*a* (& 15*b*) from the central fitting 11, the ends of each segment being threaded into the exterior portions 25 thereof. The opposed ends of fitting 11 are each chambered to form annular dished surfaces 17*a* and 17*b* around the emerging portions of the wire 15. A length of a tubular, foam rubber, sleeve 31*a* and 31*b* are then fitted on the corresponding segments 15*a* and 15*b*, each of the sleeves including a central opening 32 conformed for a fitted receipt of the wire 15. Each of the sleeves, moreover, is coated, covered, or skinned with an exterior coating 33** which is somewhat less compliant than the foam material of the sleeve itself. This exterior coating provides for hoop retention of any compressive forces along the axis of the sleeve.

Thus, axial compression of each sleeve will resolve itself in material bunching or accumulation along the central opening 32. Accordingly, as the sleeves **31*a* and 31*b* are axially compressed the stresses are relieved by material accumulation in each chamfered end 17*a* and 17*b* of the central fitting 11. In this manner axial compression of the sleeves results in rotary engagement of the wire 15 to the fitting 11**.

To effect such axial compression each of the sleeves **31*a* and 31*b* is selected to a length greater than the corresponding lengths of the wire segments 15*a* and 15*b*. A pair of threaded, annular end pieces 35*a* and 35*b* then compress across corresponding dished annular washers 36*a* and 36*b* the opposing ends of each sleeve and as each piece 35*a* and 35*b* is threadably advanced onto the threaded segment 25** axial compression of the sleeve then occurs.

Preferrably, the compressive end of each piece **35*a* (and 35*b*) is conformed to the surface of the corresponding washer 36*a* (and 36*b*) with the frustoconical shape of the washer effecting a local spreading of the sleeve material. Thus, the sleeve will advance in deformation along the wire length to accumulate material against the fitting 11**.

In consequence, any bending deformation of wire 15 will be maintained in its angular alignment relative fitting 11 by the foam accumulated at the common interface. Thus, bending of the wire out of the plane of hanger 22 will be retained once each sleeve is compressed.

Obviously many modifications and changes may be made to the foregoing description without departing from the spirit of the invention. It is therefore intended that the scope of the invention be determined solely on the claims appended hereto.

I claim:

1. A clothes hanger, comprising:

a substantially cylindrical central piece provided with an axial bore axially extending therethrough said central piece being defined by a first and second end surface each generally concave and extending to said axial bore;

a metallic rod inserted into said bore and dimensioned for conforming fit therein, said rod being generally elongate in form and extending a substantially equal first and second segment distal of said first and second ends of said piece, each said first and second segment including a threaded portion at the free ends thereof;

a first and second end piece threadably engaged to said threaded portions of said first and second segments, each said end piece including a generally convex edge aligned towards said convex end surfaces, and first and second resilient tubular sleeve respectively mounted on said first and second segment each said sleeve including an exterior covering of substantially higher density than said foam material, each said sleeve being of a longitudinal dimension greater than the longitudinal dimension of said segments.

2. Apparatus according to claim 1 wherein:

said center piece includes a pivotally engaged hook assembly.

3. Apparatus according to claim 2 further comprising:

a first and second dished washer interposed between said first and second end piece and said first and second sleeve.

* * * * *